US005603646A

United States Patent [19]

Tobias

[11] Patent Number: 5,603,646

[45] Date of Patent: Feb. 18, 1997

[54] EXPEDITION JACKET

[76] Inventor: Charles S. Tobias, Main Street, Road Town, Tortola, Virgin Islands (Br.)

[21] Appl. No.: 617,588

[22] Filed: Mar. 19, 1996

[51] Int. Cl.[6] ..... B63C 9/08

[52] U.S. Cl. ..... 441/94; 441/106; 441/108; 441/116

[58] Field of Search ..... 441/94, 92, 102

[56] References Cited

U.S. PATENT DOCUMENTS

| | | | |
|---|---|---|---|
| 141,631 | 8/1873 | Cogswell . | |
| 252,828 | 1/1882 | Williams . | |
| 1,077,868 | 11/1913 | Berman | 441/107 |
| 1,155,207 | 9/1915 | Brokaw . | |
| 1,160,252 | 11/1915 | Brokaw . | |
| 1,162,214 | 11/1915 | Boddy et al. . | |
| 2,425,206 | 8/1947 | Ripley . | |
| 2,607,934 | 8/1952 | Bailhe . | |
| 3,019,459 | 2/1962 | Ripley . | |
| 3,199,128 | 8/1965 | Nojd . | |
| 3,266,069 | 8/1966 | O'Link . | |
| 3,266,070 | 8/1966 | O'Link | 441/112 |
| 3,362,034 | 1/1968 | Oldham . | |
| 3,441,963 | 5/1969 | Steinthal | 441/107 |
| 3,629,118 | 2/1953 | Frieder et al. | 441/110 |
| 4,137,586 | 4/1979 | Evert . | |
| 4,416,641 | 11/1983 | Spinosa et al. | 441/108 |
| 4,673,366 | 6/1987 | Hawkins . | |
| 4,864,656 | 9/1989 | Nesse | 441/106 |

*Primary Examiner*—Stephen Avila
*Attorney, Agent, or Firm*—David H. Semmes

[57] ABSTRACT

A protective expedition jacket, including a vest with emergency inflation bladder; detachable sleeves secured to the vest sides and a full length waterproofing bib and storm collar secured to the front of the vest. The inflatable flotation bladder is supported within the vest back and extends through the shoulders to the left and right side of the vest front with an inflation valve extending through the vest front beneath a detachable tear-away cover.

2 Claims, 13 Drawing Sheets

EXPEDITION JACKET

CROSS-REFERENCE TO RELATED APPLICATIONS

A companion application to Expedition Jacket (Design Ser. No. 29/047,184), filed Nov. 28, 1995.

BACKGROUND OF THE INVENTION

1. Field of the Invention

Outdoor, waterproof jackets featuring an emergency inflatable vest. The jacket front includes a detachable covering panel which enables immediate access to manual and $CO_2$ cartridge inflation components. The jacket is especially designed for heavy duty wear, such as in ocean sailing.

2. Description of the Prior Art

Primary references:

2,425,206 RIPLEY
3,199,128 NÖJD
3,362,034 OLDHAM
3,441,963 STEINTHAL
4,137,586 EVERT
4,673,366 HAWKINS

Secondary references:

141,631 COGSWELL
252,828 WILLIAMS
1,155,207 BROKAW
1,160,252 BROKAW
1,162,214 BODDY et al.
2,607,934 BAILHE
3,019,459 RIPLEY
3,266,069 O'LINK

The foregoing patents are discussed in a INFORMATION DISCLOSURE STATEMENT, being separately filed.

SUMMARY OF THE INVENTION

The present expedition jacket is characterized by its rugged, waterproofing and protective features, as well as a hidden emergency inflatable vest. The jacket may be stripped of its sleeves, such that the torso portion of the jacket may serve as a photographer's vest. The front of the jacket includes an inner waterproofing bib and outer storm flaps, as well as a plurality of utility pockets and an attached "D" ring and snap shackle. The jacket may be fabricated from microfiber, an extremely tightly woven blend of nylon and cotton, rendering the jacket wind and water resistant.

The jacket front features an emergency pocket with detachable cover which supports a manual inflation tube, as well as a $CO_2$ inflation cartridge and activating device and a whistle. These emergency elements are accessed simply by ripping the panel free of its VELCRO®-type securement.

DESCRIPTION OF THE PREFERRED EMBODIMENTS

Figure 1:
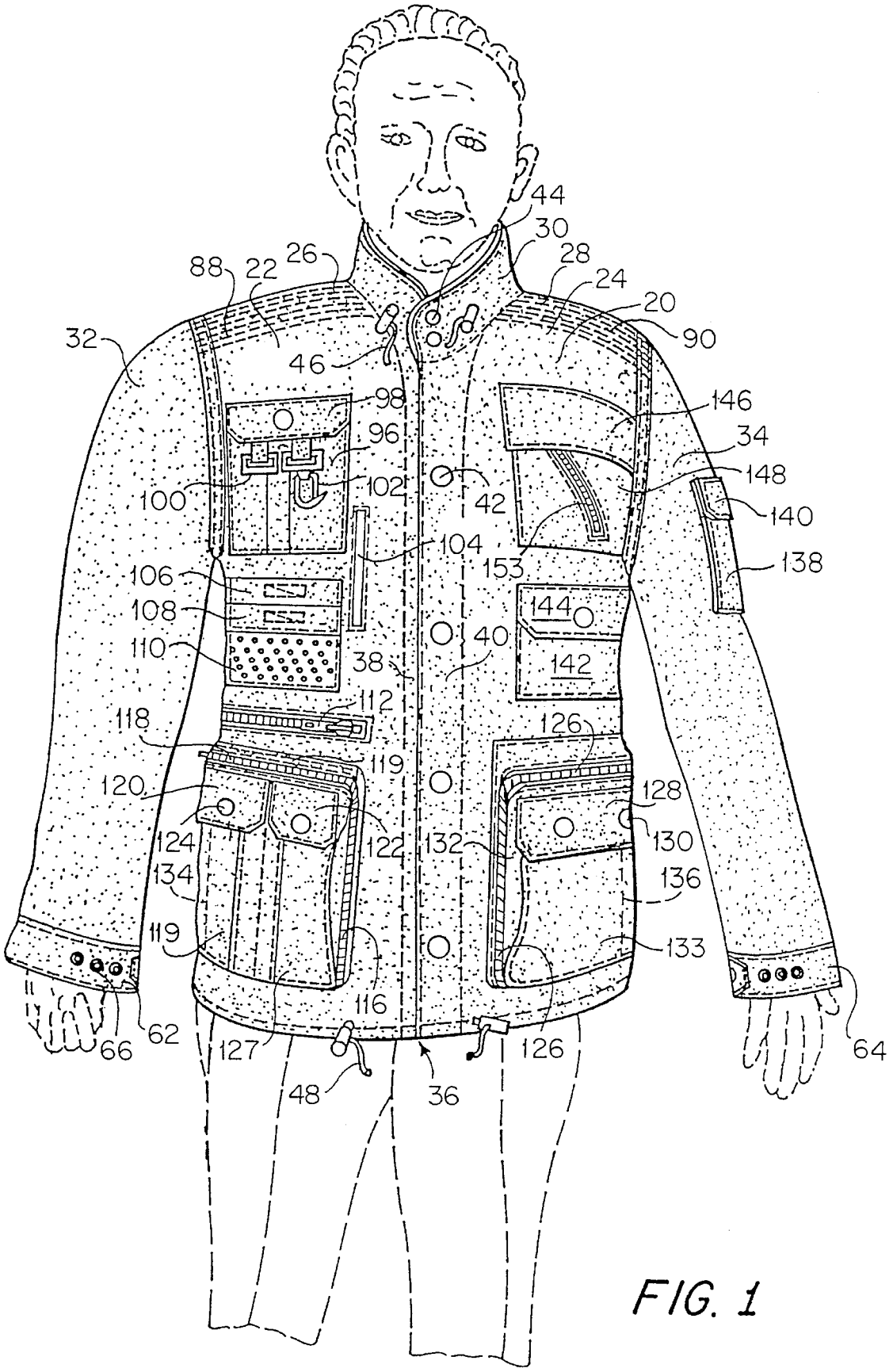
FIG. 1 is a front elevation of the expedition jacket, as conformed to the human torso.
Figure 5:
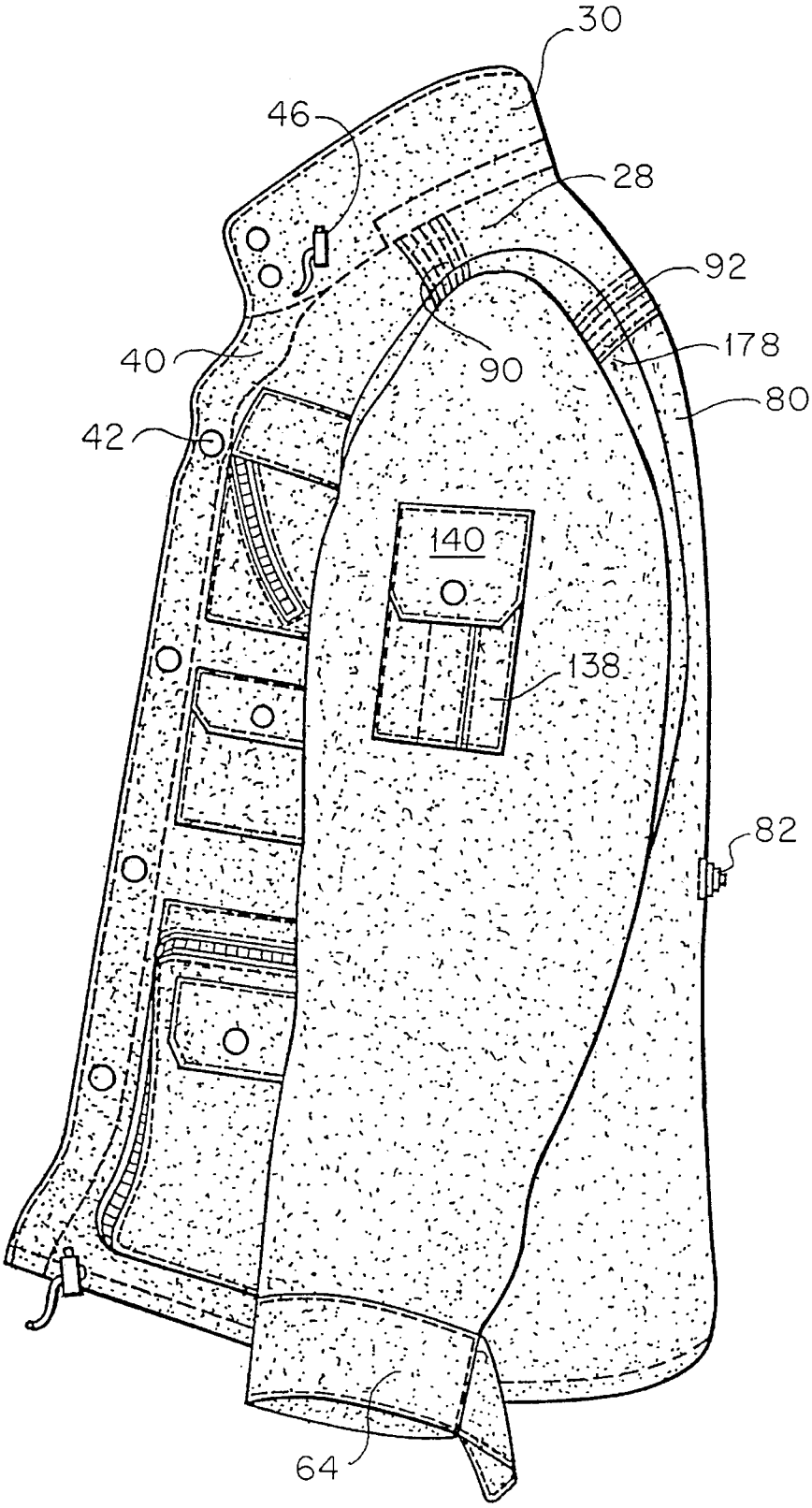
FIG. 5 is a left hand elevation of the expedition jacket, showing the back panel open gusset and left sleeve pocket for pens.

In FIGS. 1 and 5 the expedition jacket 20 is shown as embodying back portion 80 extending via stitched shoulder portions 26 and 28, respectively, to right front panel 22 and left front panel 24. A protective collar 30 encircles the neck opening and is secured by means of conventional pressure fastener 44, as well as adjustable top draw string 46. Detachable sleeves 32, 34, are secured respectively to front panel 22 and front panel 24 by means of zippers shown in phantom and encircling the entire arm cavity. Sleeves 32, 34 are secured at their ends by means of three position adjustable cuffs 62, 64, embodying conventional fasteners 66. The jacket includes storm flaps 38, 40 secured by means of pressure fasteners 42, so as to overlap vertically extending full length bib panels 50 secured to each other by means of zipper 56 and fastener 58. A knit-ribbed front collar 68 encircles the neck opening adjacent bib panels 52, 54, so as to provide additional closure.

Side entry hand warmer pockets 134, 136 are shown in phantom in the lower portion of the front panels. The jacket design may include as many as 16 front panel pockets; for example, expansible pocket 96 with covering flap 98 secured by conventional pressure snap and including a "D" ring attachment for an emergency flasher (not shown) which would be secured within pocket 96, as well as a "D" ring closure for snap shackle 102. A stash pocket with a vertical zipper closure 104 may be presented adjacent the storm flaps 38, 40. Double patch pockets 106, 108, the latter with mesh ventilating cover 110 may be secured by conventional Velcro® means shown in unnumbered and rectangular phantom.

Figure 2:
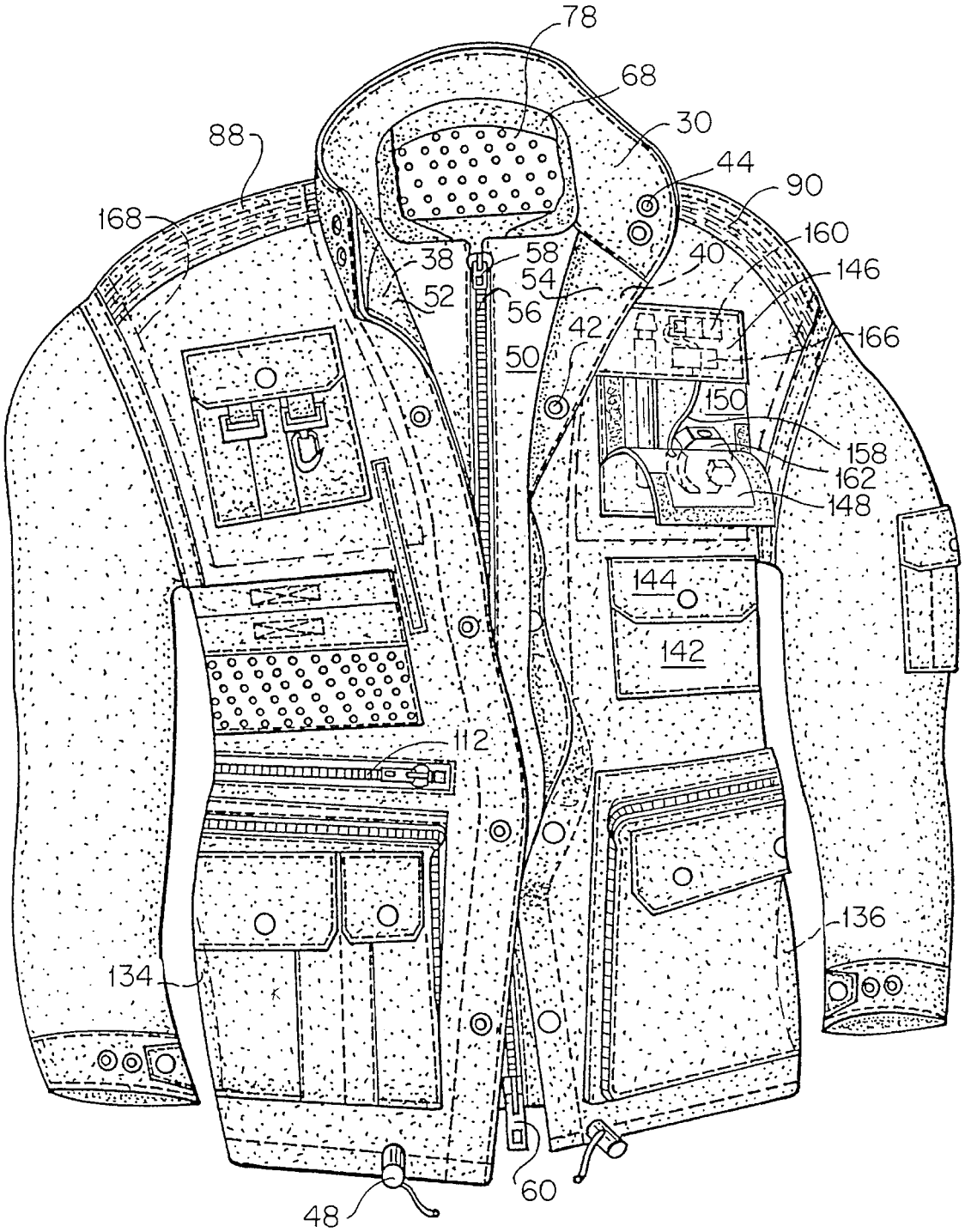
FIG. 2 is a front elevation of the expedition jacket, showing the double storm flap opened, so as to reveal the vertically extending inner bib.
Figure 12:
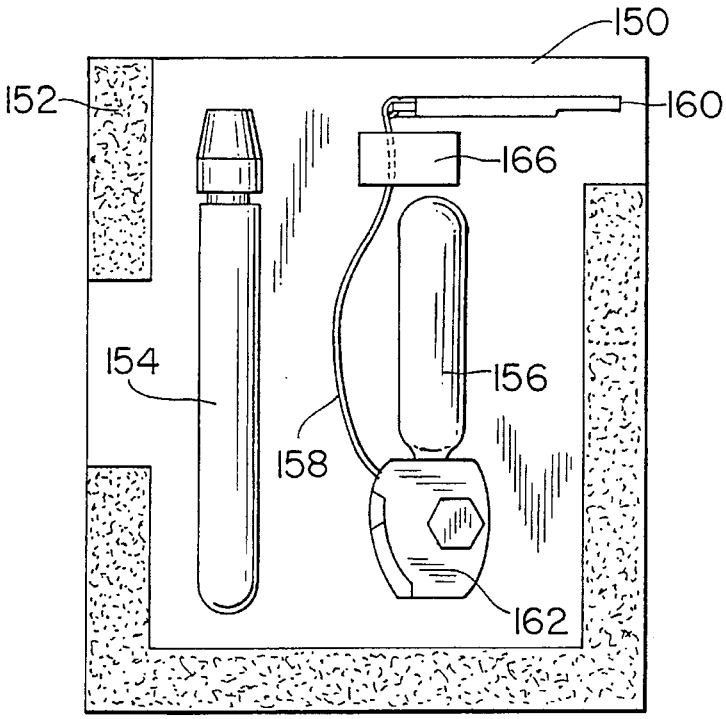
FIG. 12 is a front elevation of the inflation panel secured to the left front of the jacket as a support for the manual inflation tube and the emergency $CO_2$ flotation device, such that an outer pocket flap (not shown) may be removably secured to the panel by the peripheral Velcro®-type closures 152.
Figure 13:
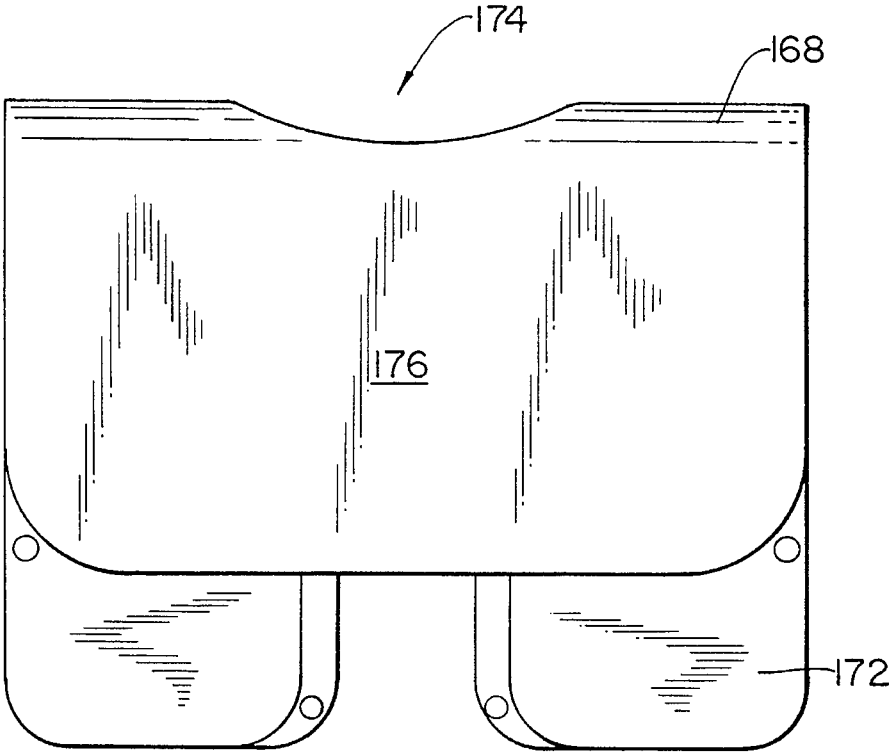
FIG. 13 is a rear elevation of the inflation bladder.
Figure 14:
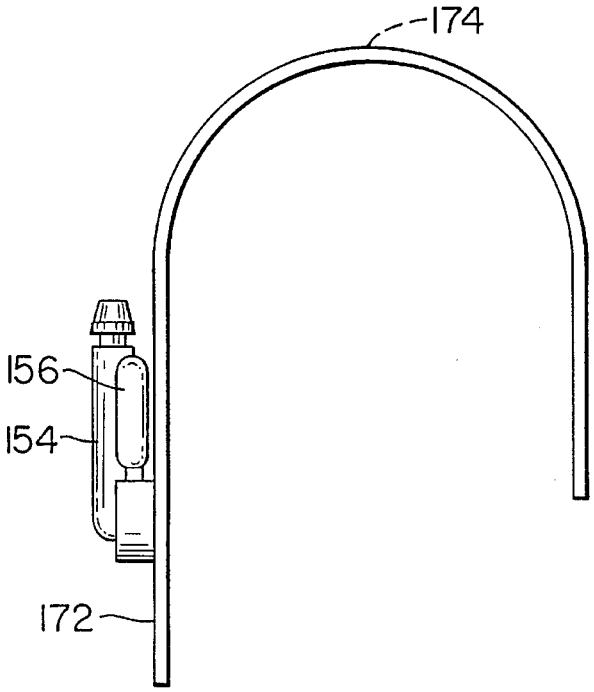
FIG. 14 is a side elevation of the inflation bladder.

A nylon lined water proof zippered pocket may be secured by zipper 112 and closure 114. Lower double bellows pocket 116 may be secured by zipper 118 and include discrete storing portions 119, 127 covered by protective flaps 120, 122 and secured by conventional snaps 124. On the left front upper portion, emergency panel 150 with zipper closure 153 may be positioned beneath detachable protective which is sewn at its top and sides to panel 24, so as to overlie cover 148 and tab 146. As shown in FIGS. 2 and 12, inner panel 150 may support manual inflation tube 154 and emergency $CO_2$ flotation device 162.

As shown in FIG. 1, front utility pocket 142 may be covered and protected by tab 144. Lower fully gusseted zip-around pocket 132 may be closed by zip-around zipper 126. Outer lower pocket 133 may include a stretch top edge so as to automatically close about the pocket contents.

In FIGS. 2 and 12, removable cover 148 of panel 150 is shown. As the manual inflation tube 154 or the emergency $CO_2$ inflation system 162 are desired to be activated, cover 148 is simply detached from its peripheral Velcro®-type fastenings which are shown partially in phantom. Cover 148 may include an outter pocket secured by zipper 153 to enclose spare $CO_2$ cylinders.

Also depicted in FIG. 2, is upper ventilating webbing 78 which may be employed intermediate jacket liner 180 and inflation tube 168.

Figure 3:
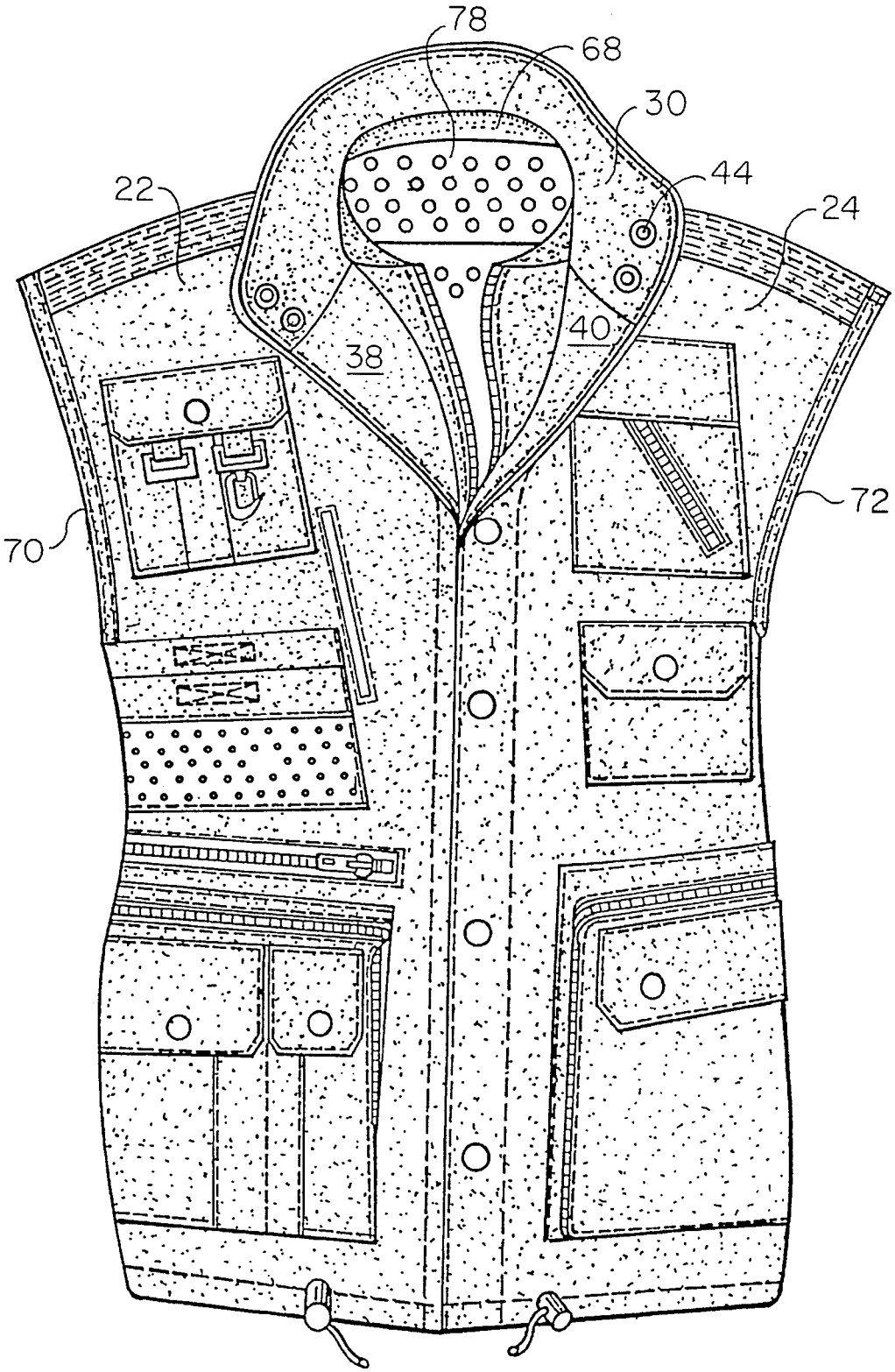
FIG. 3 is a front elevation showing the expedition jacket in vest mode with the sleeves removed.
Figure 4:
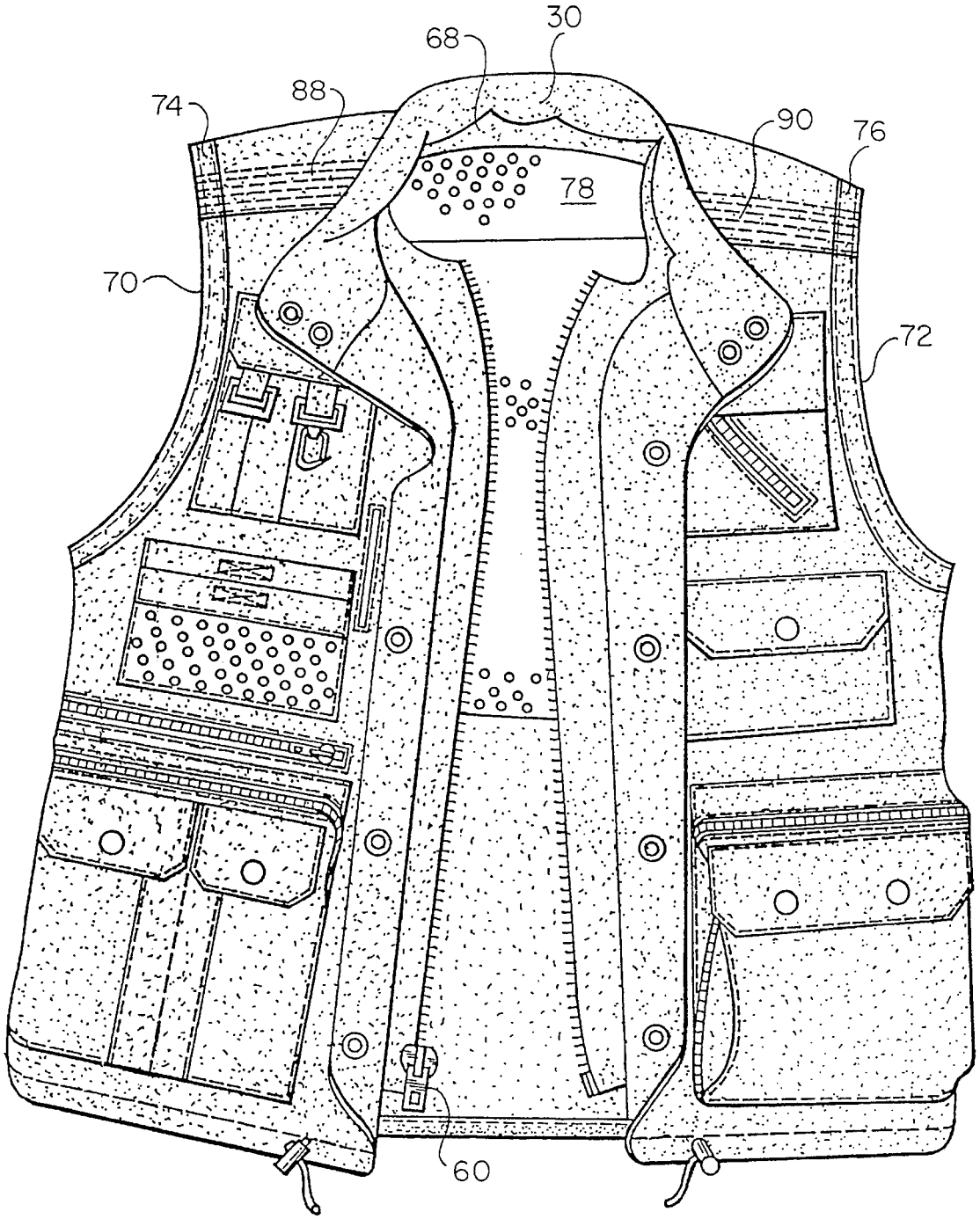
FIG. 4 is a front elevation of the expedition jacket in vest mode, showing the front storm flaps and the vertical bib opened with sleeves removed.

In FIGS. 3 and 4, the expedition jacket is shown in vest mode with the sleeves 32, 34 removed by zippers 70, 72, such that the jacket may serve as a photographer's vest. In FIG. 4 the photographer's vest is shown as opened.

In FIG. 5, there is illustrated the reinforced stitching 90, 92 which extends through double layered shoulder 28 and the gusseted double panel rear 178. Sleeve pencil pocket 138 is shown as embodying conventional tab cover 140. Also shown is lower "game" pocket secured by means of conventional zipper element 82.

Figure 6:
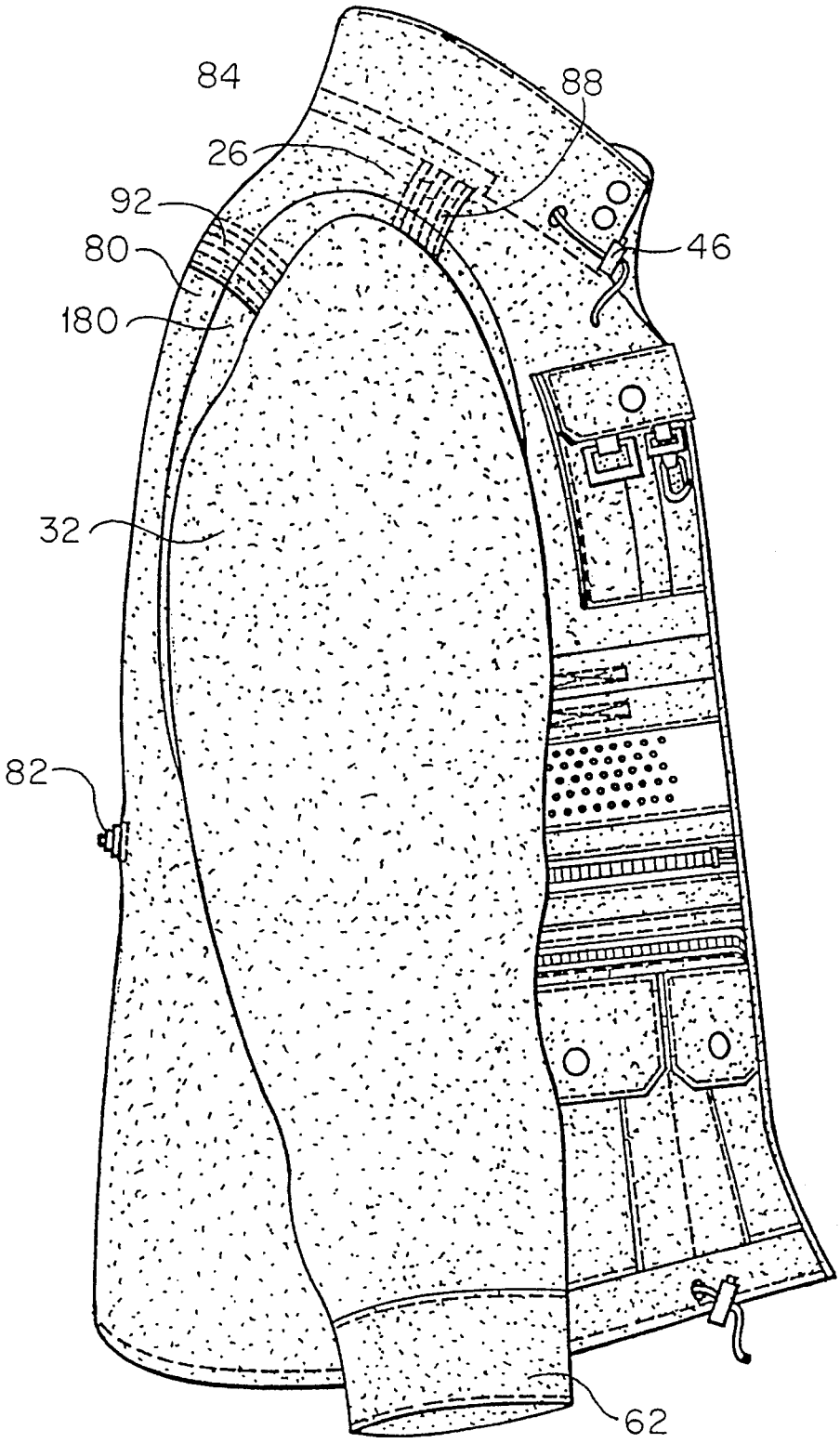
FIG. 6 is a right hand elevation showing the back panel with open gusset.

FIG. 6 illustrates the shoulder 26 as reinforced by horizontal stitching elements 88, 92 and extending into gusset element 180.

Figure 7:
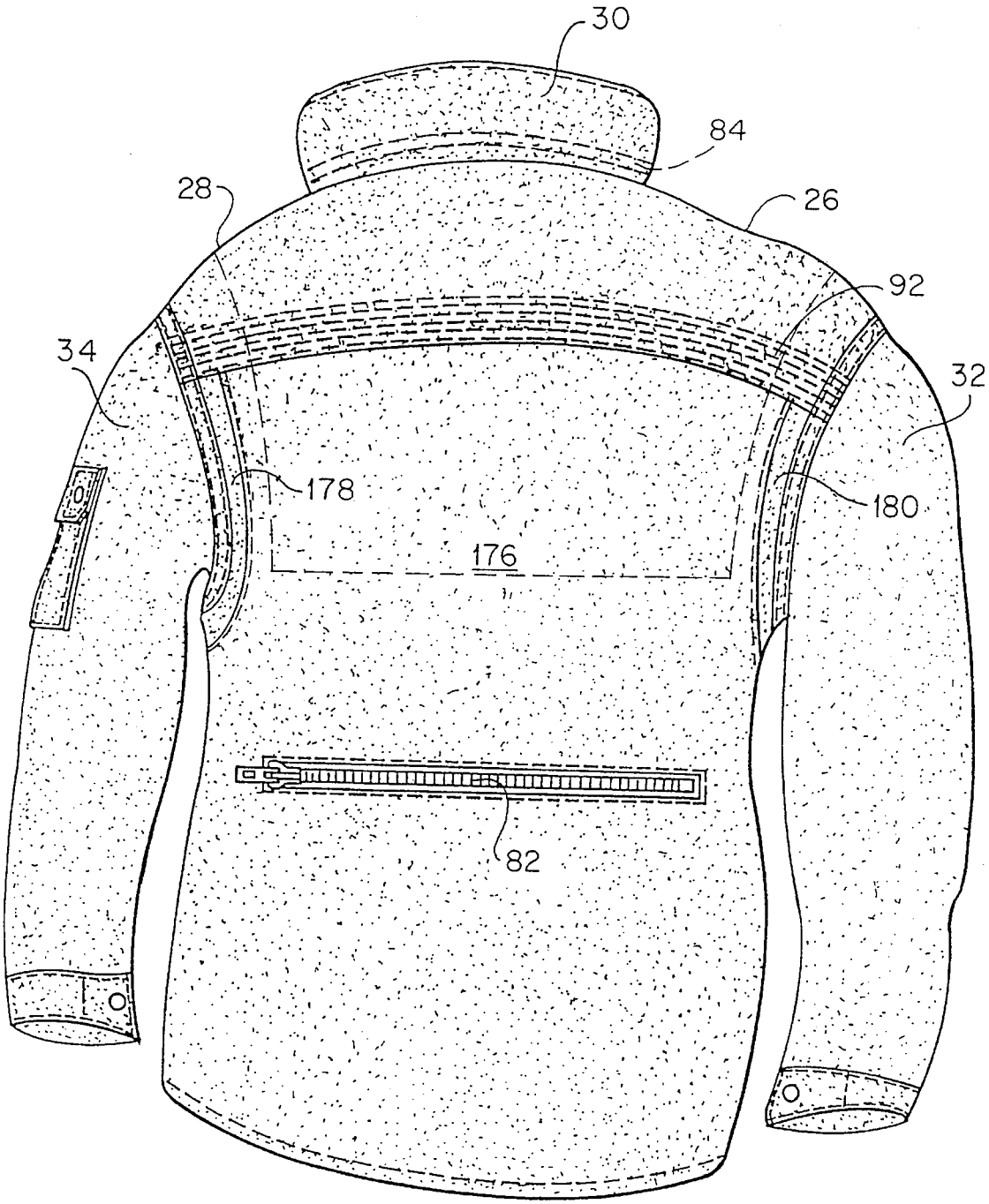
FIG. 7 is a rear elevation showing the reinforced horizontal stitching between sleeve openings and the lower "game pocket" 82.

In FIG. 7, the inflatable bladder back panel 176 is illustrated in phantom and is shown as extending over shoulder portions 26, 28 to join front panels 170, 172.

Figure 8:
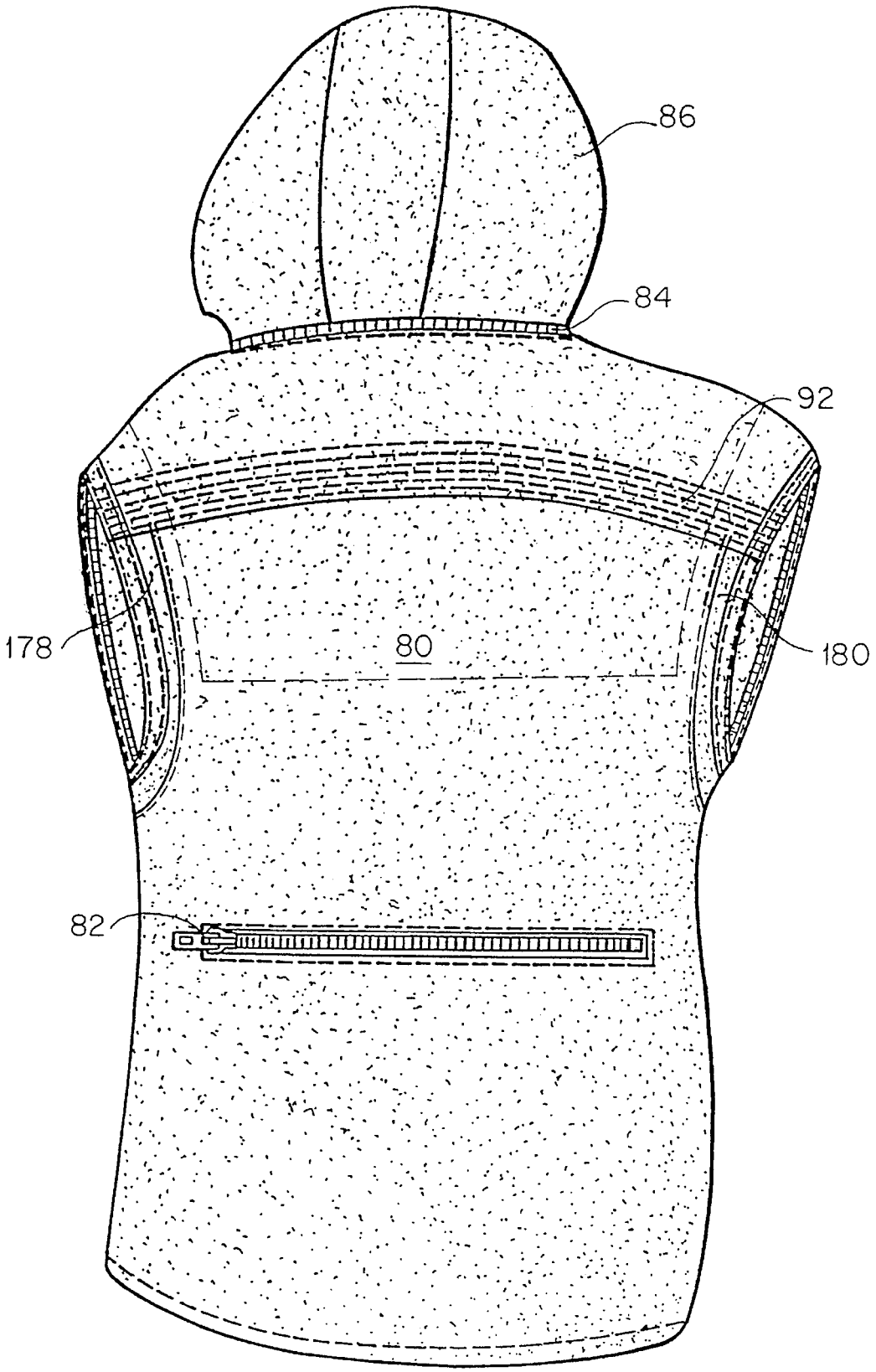
FIG. 8 is a rear elevation of the expedition jacket in vest mode with sleeves removed and showing deployment of the hood.

In FIG. 8, the expedition jacket is shown in vest mode with sleeves 32, 34 removed and hood 86 deployed from collar zippered pocket defined by zipper 84.

Figure 9:
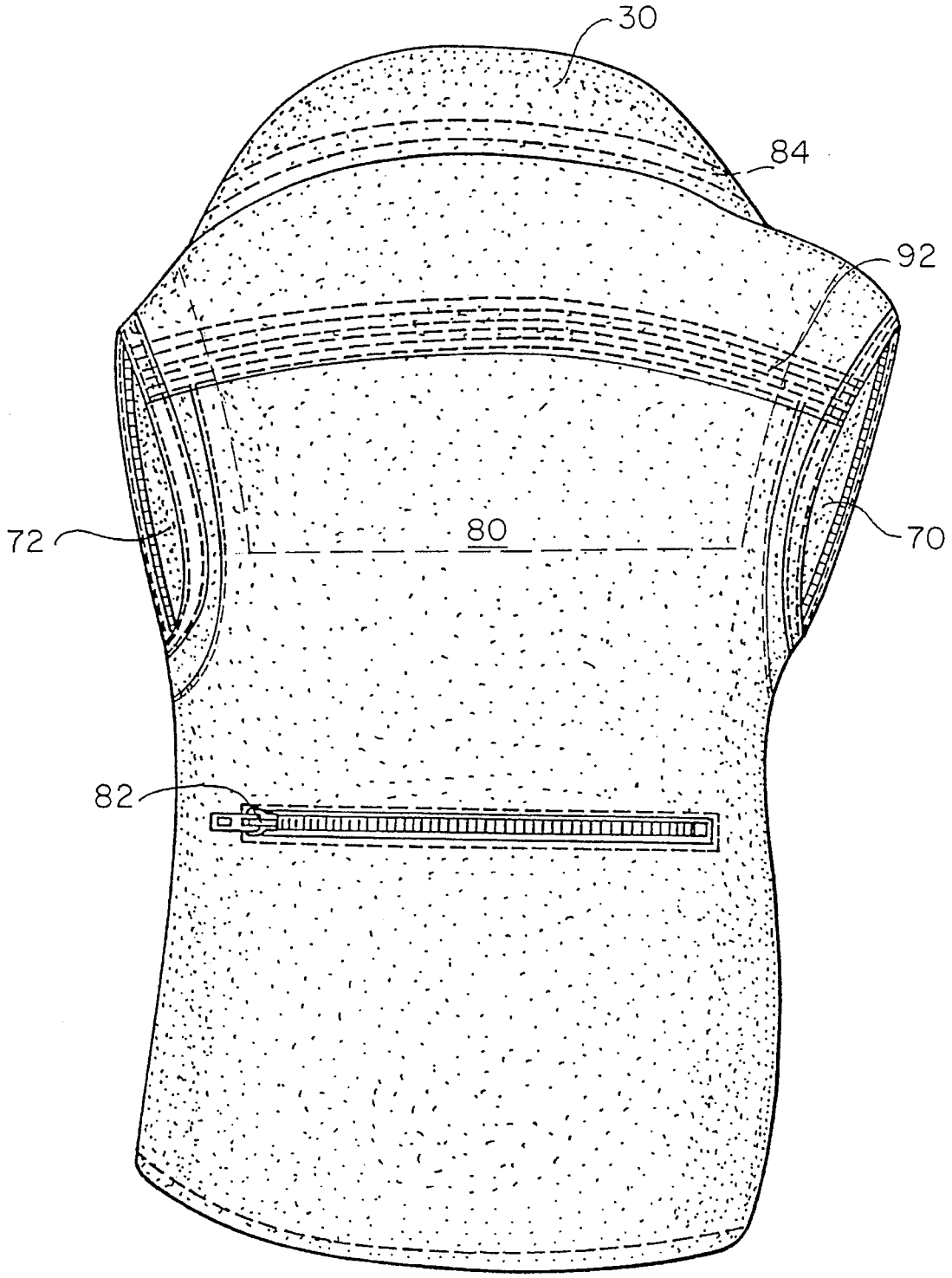
FIG. 9 is a rear elevation of the expedition jacket in vest mode with the hood stored within a zippered collar closure.

FIG. 9 is a similar view showing hood 30 returned to collar 30 pocket 84.

Figure 10:
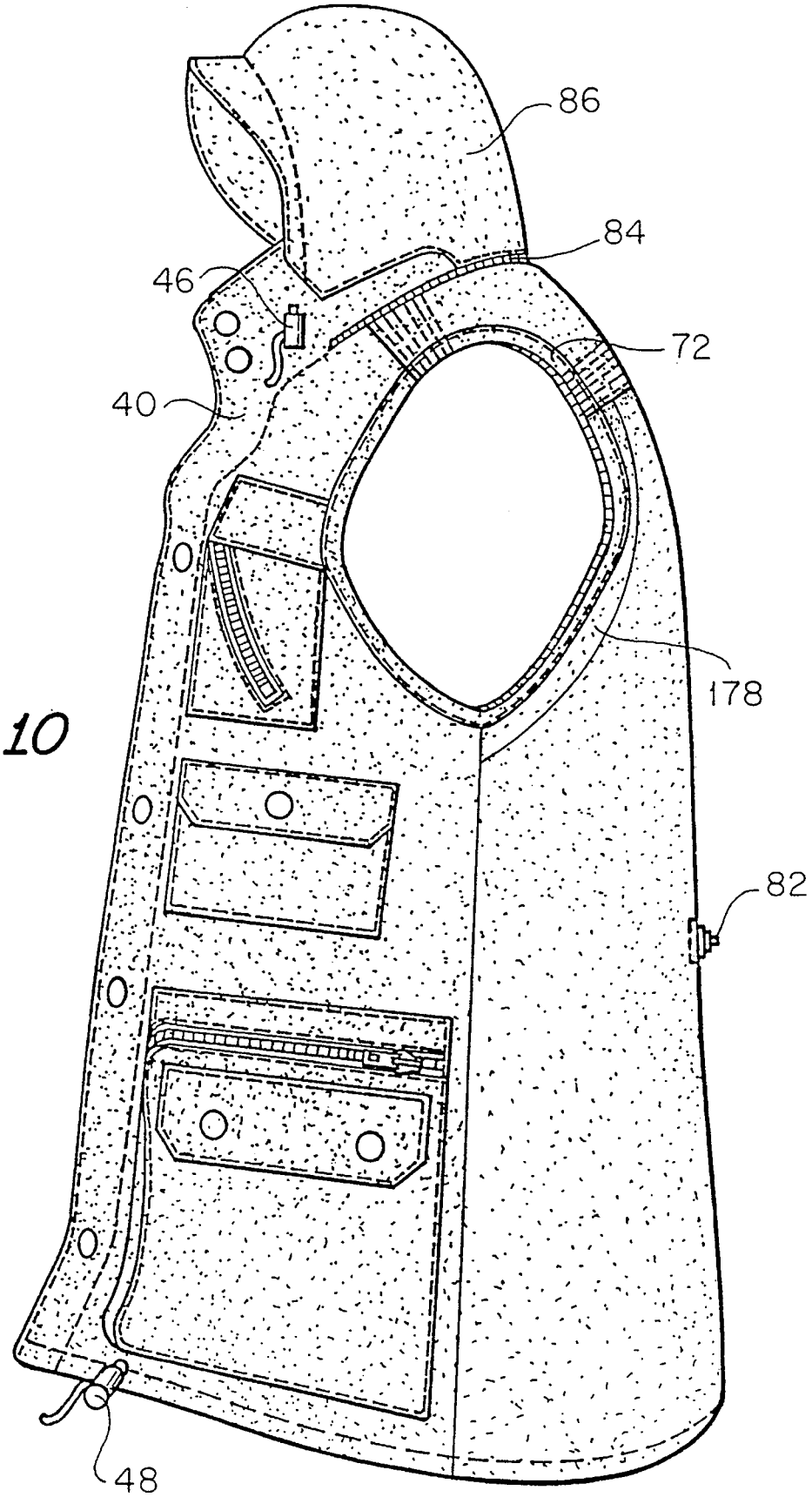
FIG. 10 is a side elevation of the jacket in vest mode with the hood deployed.

FIG. 10 is a side elevation showing the expedition jacket with hood 86 deployed, as in FIG. 8.

Figure 11:
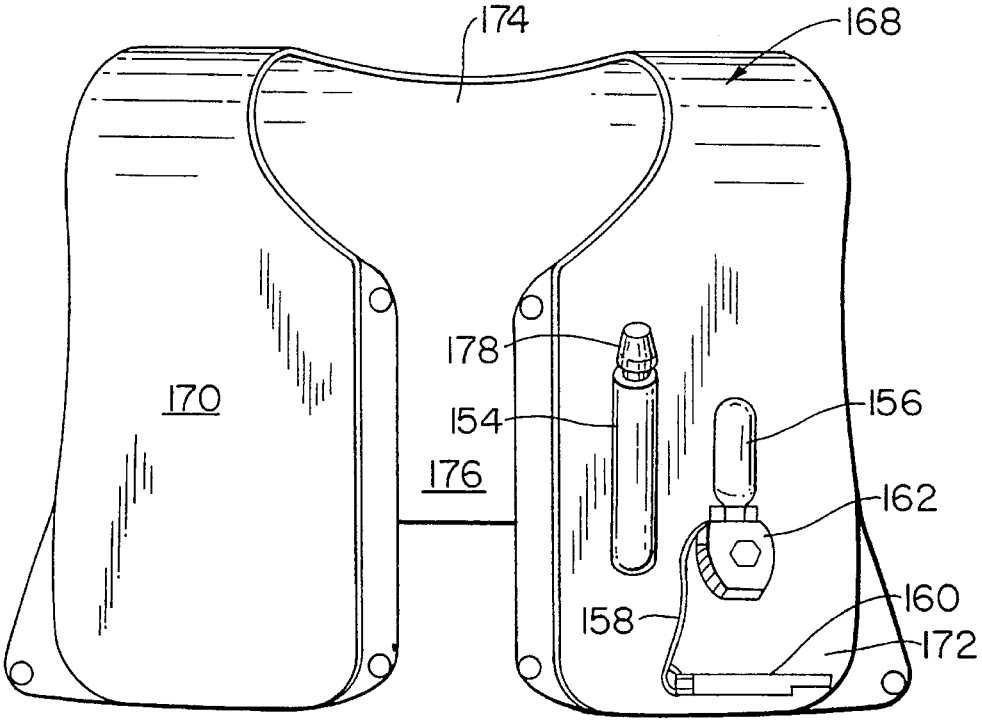
FIG. 11 is a front elevation of the inflatable bladder with manual inflation tube and emergency $CO_2$ flotation system.

FIG. 11 is a front elevation of the inflatable bladder 168, embodying back portion 60 extending over the shoulders to front panels 170, 172, the latter supporting manual inflation tube 154 and depressible valve 178 and a rotary activating element 162 for discharging $CO_2$ cartridge 156 by pulling of string 158. An emergency whistle 160 may also be attached to element 62.

In FIG. 12, there is shown inflation tube 154 emergency $CO_2$ cartridge 156. Pull string 158 may be secured to movable panel cover 150 by means of patch 166 sewn to cover 150.

Figure 15:
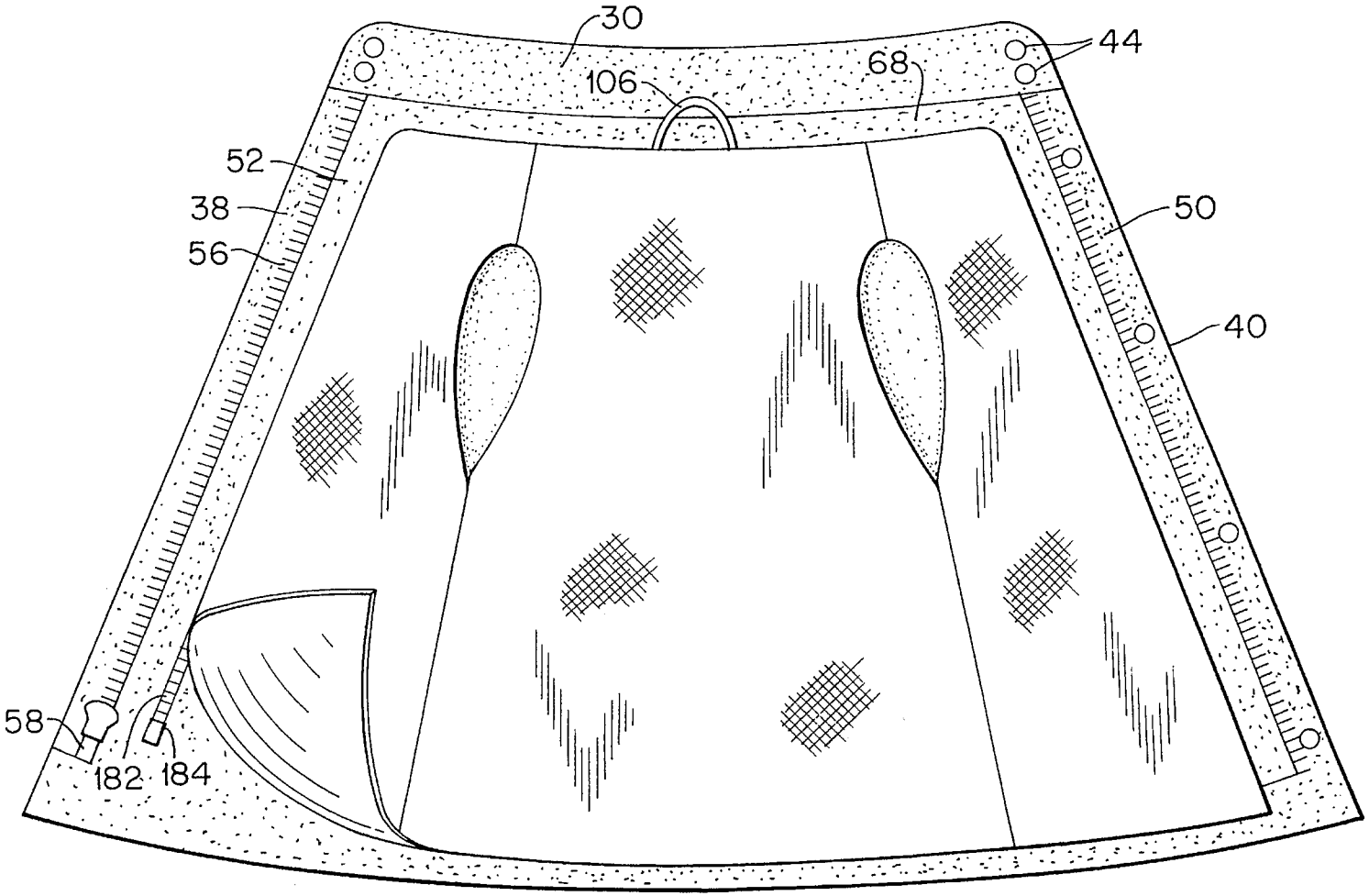
FIG. 15 is a front elevation of the expedition jacket opened at the storm flap and vertical bib, so as to expose the detachable inner lining.

In FIG. 15, inner "polar fleece" detachable lining 180 is shown as secured to collar 30 and storm bib elements 50, 52 by means of zipper 182 and zipper tap 184. Inner detachable lining 180 includes a large welt added to its periphery so as to effectively cover zipper element 182. A conventional reinforced clasp 186 may be sewn at its ends into collar 30 so as to conveniently hang the expedition jacket.

Manifestly, variations in construction and detail may be employed without departing from the spirit and scope of the claims.

I claim:

1. An inflatable and protective expedition jacket comprising:

a. a vest having a body portion adapted for the human torso and including a back and a front, said back extending laterally to a left side and a right side of said front and extending vertically via a shoulder portion to said left side and right side of said front, so as to define a central vertically extending front opening, as well as neck and arm apertures, said front further including;

i. side entry hand warming pockets defined in the left side and the right side of said front;

ii. a plurality of utility pockets defined upon the exterior of said front and including at least one pocket having a mesh ventilating cover, at least one waterproof zippered pocket having a water impervious lining and at least one bellows pocket configured in said front and having an access zipper defined at one side and on top of said bellows pocket, and iii. horizontal reinforcing stitching defined at the left and right side of said jacket front, as well as horizontal reinforcing stitching extending across the top back of said jacket;

b. detachable sleeves attached to said body portion around each of said arm apertures;

c. a full length bib and releasable closure secured to said left front and right front inwardly of said front opening;

d. a storm collar secured around the neck aperture as an extension of said full length bib;

e. an inflatable flotation bladder supported within said back and extending through said shoulder portion to said left side and right side of said front with an inflation valve extending outwardly of said front and a detachable exterior tear-away cover positioned upon said front, so as to protect said inflation valve; and an emergency pocket supporting a manual inflation tube and valve extending outwardly of said flotation bladder and an inflation cartridge and emergency actuating valve supported so as to extend outwardly of said flotation bladder beneath said tear-away cover;

f. an outer storm-flap with complementary fastening secured to each side of said front opening, so as to overlie said full length bib and closure and further including a storm collar positioned adjacent said outer storm flap adjacent said neck opening and a hood secured within an encircling pocket defined in said storm collar;

g. a sleeveless liner with vertical front closure detachably secured to the interior of said back and said front;

h. an extra protective layer secured by said reinforcing stitching at the top and extending to a game pocket defined in a lower portion of said back, and i. at least one utility shackle secured to said front of said jacket.

2. An inflatable and protective expedition jacket as in claim 1, including at least one utility shackle secured to said front of said jacket.

* * * * *